United States Patent [19]

Wedel

[11] 4,066,308

[45] Jan. 3, 1978

[54] CASH DRAWER

[75] Inventor: Mark J. Wedel, Minneapolis, Minn.

[73] Assignee: Atlas Manufacturing, Inc., Minneapolis, Minn.

[21] Appl. No.: 761,015

[22] Filed: Jan. 21, 1977

[51] Int. Cl.[2] ..... A47B 88/04; A47B 88/16

[52] U.S. Cl. ..... 312/333; 312/219; 312/319

[58] Field of Search ..... 312/333, 319, 218, 219, 312/221

[56] References Cited

U.S. PATENT DOCUMENTS

| | | | |
|---|---|---|---|
| 1,028,767 | 6/1912 | Mooney | 312/319 |
| 3,374,043 | 3/1968 | Lewin | 312/319 |
| 3,441,330 | 4/1969 | Wildi | 312/333 |
| 3,592,521 | 7/1971 | Cox | 312/333 |

*Primary Examiner*—Robert L. Wolfe
*Assistant Examiner*—Alex Grosz
*Attorney, Agent, or Firm*—Merchant, Gould, Smith, Edell, Welter & Schmidt

[57] ABSTRACT

A cash drawer movably mounted in a housing between open and closed positions and yieldingly urged toward its open position by resilient rods adjustably mounted in the housing. A latch hook releasably holds the drawer in its closed position, and a power operated device is used alternatively with a manually operated mechanism to move the latch hook in a direction to release the drawer for opening movements. The manually operated mechanism includes a latch hook engaging portion for positively locking the latch hook against drawer releasing movement, when desired. Drawer supporting slide rails are tilted to a degree which provides for substantially constant velocity of opening movement of the drawer, and a yielding friction element engages the drawer to stop opening movement of the drawer at a given position of said opening movement.

11 Claims, 7 Drawing Figures

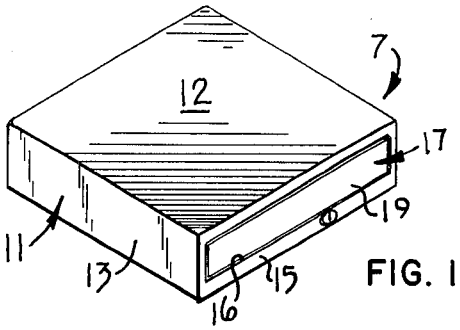
FIG. 1
FIG. 2
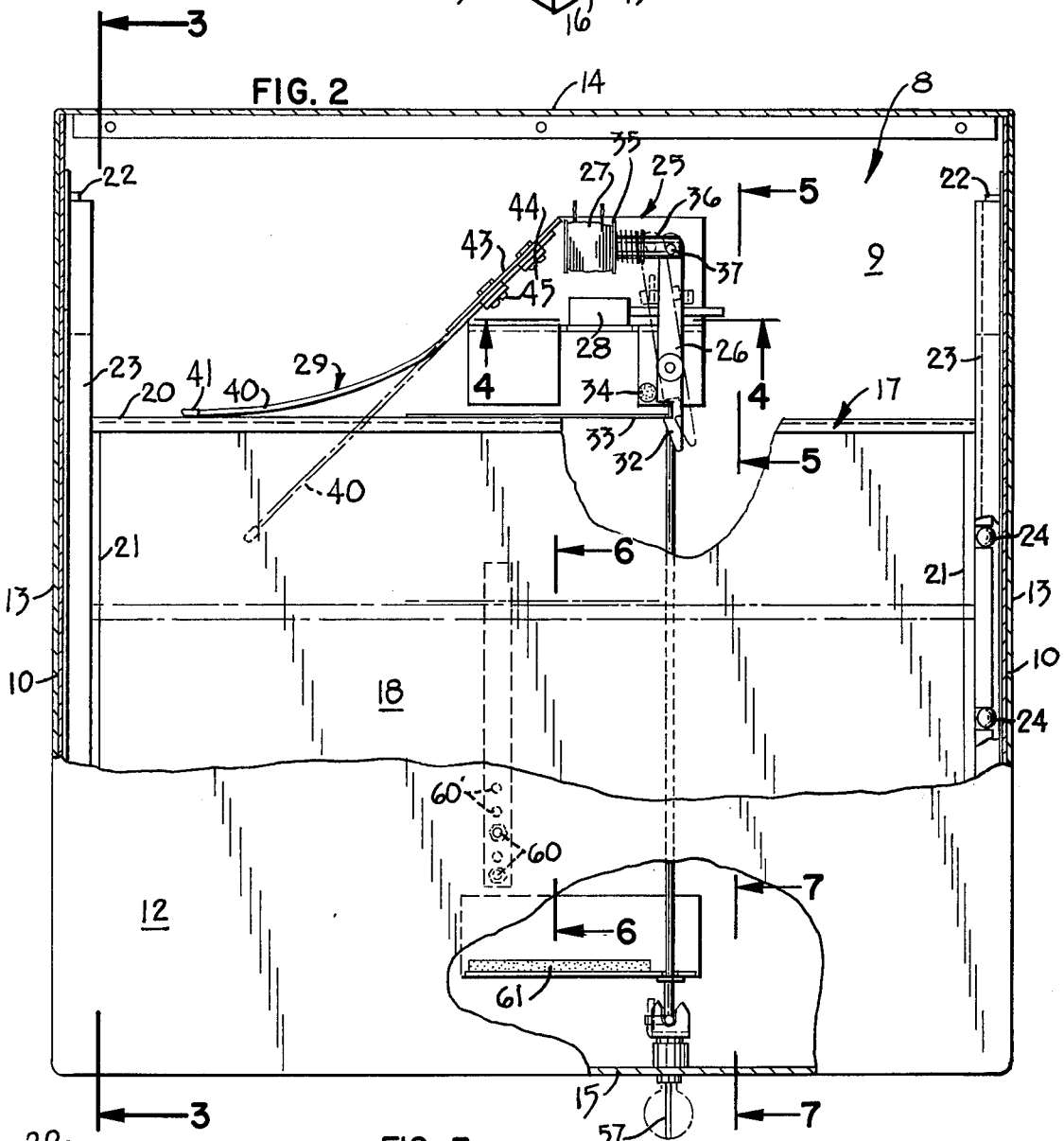
FIG. 3
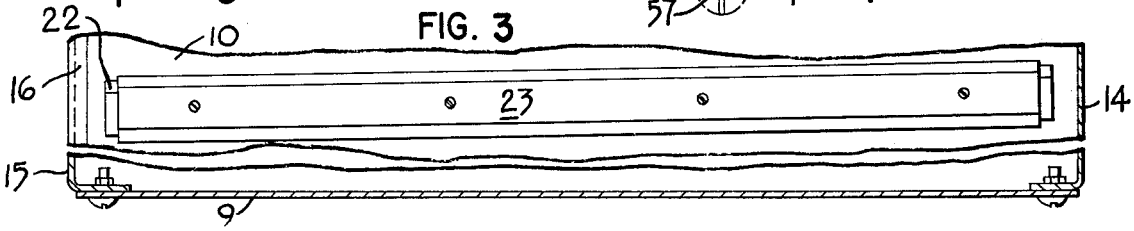

CASH DRAWER

BACKGROUND OF THE INVENTION

This invention relates generally to means for opening drawers in cabinets or like housings and, more specifically, is in the nature of cash drawer construction including improved spring means for opening the drawer, and latch and latch operating mechanism for holding the drawer closed and releasing the same for opening movement.

SUMMARY OF THE INVENTION

The cash drawer assembly of this invention involves a housing including a frame having a bottom wall and laterally spaced side walls, a drawer having front and rear walls and side walls, support means mounting said drawer in the housing for forward opening and rearward closing movements, latch means releasably holding the drawer in a closed position, and operating means for said latch means. Elongated normally straight flexible resilient rod means urge said drawer toward its open position, and bracket means support said rod means in the housing at an oblique angle to the direction of movement of the drawer for engagement of one end of the rod means by said drawer, whereby the rod means is rearwardly bent by said drawer during closing movements of the drawer. Clamping means is provided for securing the other end of said rod means to the bracket means for adjustment of said rod means longitudinally thereof on said bracket means, whereby to vary the effective bending length of said rod means.

BRIEF DESCRIPTION OF THE DRAWINGS

FIG. 1 is a view in perspective of a cash drawer assembly produced in accordance with this invention;

FIG. 2 is an enlarged view in top plan, some parts being broken away and some parts being shown in section;

FIG. 3 is a fragmentary section taken on the line 3—3 of FIG. 2.

DETAILED DESCRIPTION OF THE PREFERRED EMBODIMENT

Figure 4:
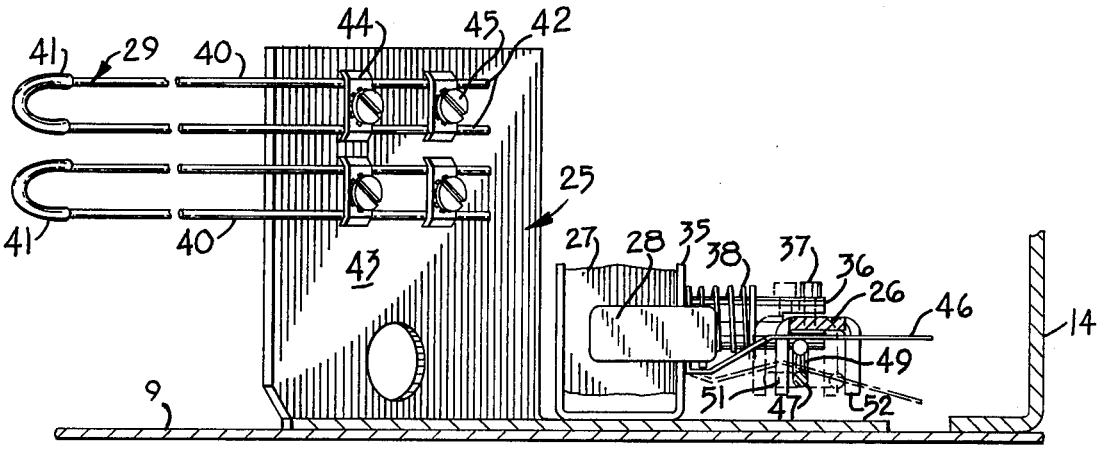
FIGS. 4, 5, 6 and 7 are enlarged fragmentary sections taken on the lines 4—4, 5—5, 6—6 and 7—7 respectively, of FIG. 2.

In the drawings, a generally rectangular housing 7 is shown as including, a frame 8 having a horizontally disposed bottom wall 9 and opposite generally vertical inner side walls 10; and a shell 11 secured to the bottom wall 9 and including a horizontal top wall 12, laterally spaced outer side walls 13 outwardly of the inner side walls 10, a rear wall 14, and a front wall 15 which defines a rectangular opening 16. A cash drawer 17 is disposed within the housing 7, and includes a bottom wall 18, front and rear walls 19 and 20 respectively, and opposite side walls 21 that are disposed in inwardly spaced parallel relation to respective ones of the frame side walls 10. The drawer 17 is adapted to hold a compartmented tray, not shown, for reception of bills and coins of various denominations.

The drawer 17 is supported for opening and closing movements relative to the housing 7 by cooperating slide rails 22 and 23, the rails 22 being rigidly secured to the frame side walls 10, the rails 23 being rigidly secured to the side walls 21 of the drawer 17. The rails 22 and 23 are of well-known construction, and are provided with rolling friction bearings 24, some of which are shown in FIG. 2.

A mounting bracket 25 is rigidly secured to the bottom wall 9 of the frame 8 and provides a support for a latch hook 26, a latch hook operating solenoid 27, a switch 28, and a pair of cantilever springs 29. The latch hook 26 is pivotally mounted intermediate its ends on a vertically extending pivot shaft 30 extending upwardly from a raised horizontal portion 31 of the bracket 25, for movements of the hooked front end portion 32 toward and away from latching engagement thereof with a rear wall portion 33 secured to and extending downwardly from the rear wall 20 of the drawer 17. The portion 31 of the bracket 25 is provided with a cushioning pad 34 that engages one side of the latch hook 26 to limit swinging movement thereof in a latching direction.

The solenoid 27 is mounted in a U-shaped frame 35 welded or otherwise rigidly secured to the bracket 25, and is provided with an armature 36 having its outer end pivotally secured to the rear end of the latch hook 26, by means of a pivot pin or like connection 37. A coiled compression spring 38 encompasses the armature 36, between one side of the frame 35 and a stop washer 39, and yieldingly urges the latch hook 26 toward engagement of the hook portion 32 thereof with the rear wall portion 33.

The cantilever springs 29 are formed from elongated rods of flexible resilient metal into elongated U-shape to provide elongated generally parallel rod sections having closed ends 41 and opposite open ends 42, the closed ends 41 being preferably covered by cushioning or sound-deadening material, such as synthetic plastic material or other suitable substance. Adjacent their open ends 42, the springs 29 are adjustably mounted on a plate-like portion 43 of the bracket 25, the plate-like portion 43 extending upwardly from the bottom frame wall 9 and disposed at an angle oblique to the direction of opening and closing movements of the drawer 17, see particularly FIG. 2. The rod sections 40 are secured to the plate-like portion 43 by clamping plates 44 which straddle the rod sections 40 of their respective springs 29, and nut-equipped clamping screws 45, see particularly FIGS. 2 and 4. As shown by broken lines in FIG. 2, the rod sections 40 are normally straight and extend in a direction parallel to the plate-like bracket portion 43, so that the closed ends 41 of the springs 29 engage a portion of the rear wall 20 of the drawer 17 during closing movements of the drawer 17. As shown by full lines in FIG. 2, the springs 29 are bent rearwardly when the drawer 17 is in its closed and latched position, and yieldingly urge the drawer 17 toward its open position upon movement of the latch hook 26 to release its hold upon the rear wall portion 33 of the drawer 17. By loosening of the clamping screws 45, the cantilever springs 29 may be moved in directions longitudinally thereof with respect to the plate-like portion 43, so as to vary the effective length of the springs 29, and thus vary the yielding bias thereof against the drawer 17 in a drawer-opening direction.

Although not shown, it may be assumed that the solenoid 27 is contained in electrical circuitry including the switch 28 and a remote manually operated switch not shown. In and of itself, the circuitry does not comprise the instant invention. Hence, in the interest of brevity, detailed showing thereof is omitted. It should suffice to state that the switch 28, when closed, permits the solenoid 27 to be energized; and, when opened, the switch 28 prevents the solenoid 27 from being energized. The switch 28 is provided with an operating arm, indicated at 46.

Figure 5:
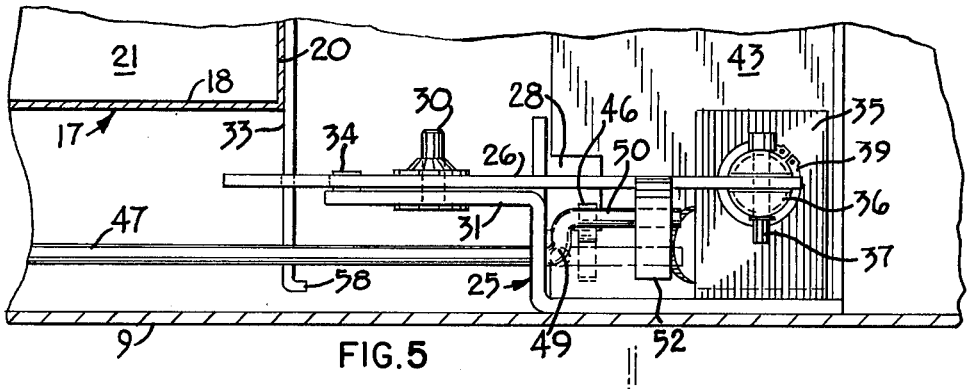
Figure 7:
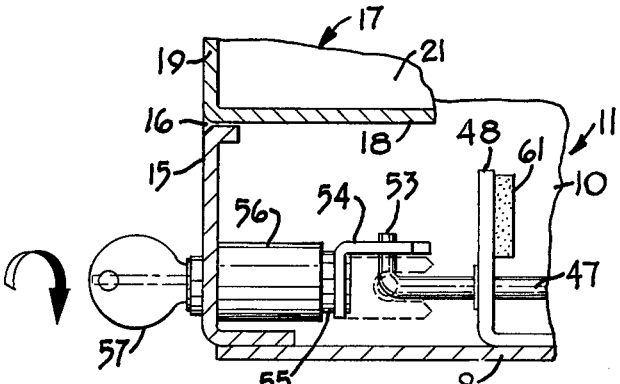

Other means for operating the latch hook 26 and for controlling the operation of the latch hook 26 comprises an elongated shaft 47 having a rear end portion that is journaled in the bracket 25 and a front end portion that is journaled in another bracket 48 secured within the housing 7 near the front wall 15 thereof, see particularly FIGS. 5 and 7. At its rear end, the shaft 47 is formed to provide a crank arm 49 and a rearwardly projecting crank pin portion 50 that is adapted to selectively engage a pair of laterally spaced abutments in the nature of ears 51 and 52 projecting downwardly from the latch hook 26 intermediate the pivot shaft 30 and pivot pin 37. At its front end, forwardly of the bracket 48, the shaft 47 is bent at right angles to provide a radially projecting drive portion 53 that is engaged by a drive fork 54 mounted on the inner end of the spindle 55 of a cylinder lock 56. The lock 56 is of conventional construction, and is provided with a removable key 57 in the usual manner.

The crank arm 49 is adapted to be turned by the key 57 selectively in opposite directions from a neutral position wherein the crank arm 49 extends vertically upwardly from the axis of the shaft 47. In the neutral position of the crank arm 49, the crank pin portion 50 engages the switch arm 46 to close the switch 28. With reference to FIG. 4, it will be seen that in its neutral position, the crank arm 49 is disposed in closely spaced relationship to the abutment 51 and relatively remote from the abutment 52. With the crank arm 49 in its vertical neutral position, the latch hook 26 is free to be moved in an unlatching direction by the solenoid 27. Rotation of the shaft 47 in a clockwise direction with respect to FIG. 4, to a point wherein the crank arm 49 is horizontally disposed, causes the switch 28 to be opened and brings the crank pin portion 50 substantially into engagement with the abutment 52 to positively hold the latch hook 26 against unlatching movement, thus effectively locking the drawer 17 against opening movement. In this position of the crank arm 49, the key 57 may be withdrawn from the lock 56, so the contents of the drawer will be safe.

The drawer 17 may be opened by means of the key 57 and without the necessity of energizing the solenoid 27, by turning the shaft 47 in a counterclockwise direction with respect to FIG. 4, the crank pin portion 50 engaging the abutment 51 and moving the same in a direction to unlatch the drawer 17, as shown by dotted lines in FIGS. 2 and 4.

Figure 6:
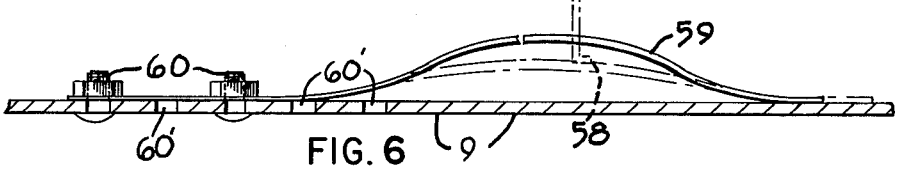

When the latch hook 26 is released from latching engagement with the rear wall portion 33 of the drawer 17, either by means of the solenoid 27 or the key 57, the springs 29 will impel the drawer 17 forwardly toward an open position. As soon as the drawer 17 has moved forwardly a short distance, it is released from engagement with the springs 29, and continues to roll forwardly on its own momentum. With reference to FIG. 3, it will be seen that the slide rails 22 and 23 are disposed to gently slope downwardly from their rear ends adjacent the rear wall 14 to their front ends adjacent the front wall 15. While only one cooperating pair of rails 22 and 23 is thus shown, it may be assumed that the other pair thereof slopes likewise at the same angle. The slope angle of the rails is obtained mathematically, using Newton's second law of motion and the coefficient of rolling friction between the slide rails 22 and 23. The angle of slope is such as to maintain the velocity of opening movement of the drawer 17 substantially constant during free movement of the drawer 17 in its opening direction. The lower edge portion of the rear wall portion 33 is bent rearwardly to provide a horizontal lip 58 that is adapted to slidingly engage a flexible leaf spring 59 anchored at one end portion to the bottom wall 9 of the frame 8, by nut-equipped screws 60 in selected ones of longitudinally spaced openings 60' in the bottom wall 9. During forward movement of the drawer 17, the lip 58 deforms the spring 59, as shown in FIG. 6, the frictional engagement therebetween causing the drawer 17 to stop before it reaches its fully open position wherein the rear wall portion 33 engages a cushion 61 on the bracket 48. Preferably, the drawer is stopped by the spring 59 when only the front portion of the drawer is disposed outwardly of the housing 7, so that only coins in the front portion of the tray, not shown, are exposed. When it is desired to insert bills into the tray or withdraw bills therefrom, the drawer may be manually pulled to its full open position so that the bill compartments in the rear portion of the tray are exposed. It will be noted that the spring 59 may be moved longitudinally of the direction of movement of the drawer 17 so that the drawer 17 may be stopped thereby in various desired positions of its forward movement.

While a commercial embodiment of the cash drawer assembly of this invention has been shown and described, it will be understood that the same is capable of modification without departure from the spirit and scope of the invention, as defined in the claims.

What is claimed is:

1. A cash drawer assembly comprising:

a. a housing including a frame having a bottom wall and laterally spaced side walls;

b. a drawer having front and rear walls and side walls;

c. support means mounting said drawer in said housing for forward opening and rearward closing movements;

d. latch means releasably holding said drawer in a closed position;

e. operating means for said latch means;

f. elongated, normally straight flexible resilient rod means for urging said drawer toward its open position;

g. bracket means for supporting said rod means in said housing at an oblique angle to the direction of movement of said drawer for engagement of one end of the rod means by said drawer, whereby said rod means is rearwardly bent by said drawer during closing movements of the drawer;

h. and clamping means securing the other end of said rod means to said bracket means for adjustment of said rod means longitudinally thereof on said bracket means, whereby to vary the effective bending length of said rod means.

2. The cash drawer assembly defined in claim 1 in which said rod means comprises an elongated rod formed into U shape to provide elongated, generally parallel rod sections and open and closed ends, said closed end engaging said drawer.

3. The cash drawer assembly defined in claim 2 in which said bracket means includes a plate-like portion disposed at said angle oblique to the direction of travel of the drawer, said clamping means comprising a pair of clamping elements spaced apart longitudinally of said rod sections and releasably clamping said rod sections to said plate-like portion.

4. The cash drawer assembly defined in claim 1 in which said rod means comprises a pair of spaced generally parallel rods each formed into U shape to provide a pair of elongated parallel rod sections and open and closed end portions, said closed end portions engaging spaced portions of said drawer.

5. The cash drawer assembly defined in claim 4 in which said bracket means includes a plate-like portion disposed at said angle oblique to said direction of travel of the drawer; said clamping means comprising pairs of clamping elements spaced apart longitudinally of their respective rods, the clamping elements of each pair thereof releasably clamping their respective rod to said plate-like portion independently of the other of said rods.

6. The cash drawer assembly defined in claim 1, further including a yielding friction element mounted between adjacent portions of said housing and said drawer; said friction element being secured to one of said portions and frictionally engaging the other thereof during opening movement of said drawer to stop said opening movement before the drawer reaches a fully open position.

7. The cash drawer assembly defined in claim 1 in which said latch means comprises a latch hook pivotally mounted in said housing for swinging movements toward and away from latching engagement with a portion of said drawer; said latch operating means including a spring urging said latch hook toward latching engagement with said portion of the drawer, power operated means for moving said latch hook in an unlatching direction against bias of said spring, and a manually operated member for imparting unlatching movement to said latch hook independently of said power operated means.

8. The cash drawer assembly defined in claim 7 in which said latch includes a pair of abutments on said latch hook, said abutments being spaced apart in the direction of movement of said latch hook; said manually operated means comprising a crank pivotally mounted in said housing and having an abutment engaging crank pin portion, said crank being rotatable in one direction from a neutral position, wherein said crank pin portion is spaced apart from both of said abutments, to a locking position wherein said crank pin portion engages one of said abutments to lock said latch hook against movement in a drawer-releasing direction, and in the opposite direction wherein said crank pin portion engages the other of said abutments to move said latch hook in a drawer-releasing direction.

9. The cash drawer assembly defined in claim 8, further including lock mechanism for releasably locking said crank in the latch hook locking position thereof.

10. The cash drawer assembly defined in claim 8 in which said power-operated means includes a solenoid operatively connected to said latch hook, characterized by a control switch for said solenoid and an operating arm for said control switch, said operating arm being engaged by said crank pin, in said neutral position of said crank, to permit energization of said solenoid.

11. The cash drawer assembly defined in claim 1 in which said support means comprises cooperating slide rails mounted on said frame side walls and said drawer side walls, said slide rails sloping forwardly and downwardly at an angle permitting free forward movement of said drawer at a constant speed.

* * * * *